US006908328B2

(12) United States Patent
Lei et al.

(10) Patent No.: US 6,908,328 B2
(45) Date of Patent: Jun. 21, 2005

(54) ELECTRICAL CONNECTOR WITH ACCURATELY SECURED CONTACTS

(75) Inventors: Jinfeng Lei, Kunshan (CN); Ren-Chih Li, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 30 days.

(21) Appl. No.: 10/299,607

(22) Filed: Nov. 18, 2002

(65) Prior Publication Data

US 2003/0171040 A1 Sep. 11, 2003

(30) Foreign Application Priority Data

Mar. 8, 2002 (TW) ..... 91202773 U

(51) Int. Cl.[7] ..... H01R 13/40
(52) U.S. Cl. ..... 439/342; 439/733.1; 439/752.5
(58) Field of Search ..... 439/869, 733.1, 439/752.5, 342

(56) References Cited

U.S. PATENT DOCUMENTS 3,696,323 A * 10/1972 Kinkaid et al. ..... 439/525
4,230,383 A * 10/1980 Burnstein et al. ..... 439/620
5,299,950 A * 4/1994 Kaneko ..... 439/342
5,370,549 A * 12/1994 Lee ..... 439/342
5,453,028 A * 9/1995 Grambley et al. ..... 439/441
5,984,693 A * 11/1999 McHugh et al. ..... 439/66
6,056,576 A * 5/2000 Szu ..... 439/342
6,142,810 A * 11/2000 Hsiao et al. ..... 439/342
6,179,624 B1 * 1/2001 McHugh et al. ..... 439/71
6,213,807 B1 * 4/2001 Huang et al. ..... 439/342
6,261,132 B1 * 7/2001 Koseki et al. ..... 439/733.1
6,450,844 B1 * 9/2002 Mizumura et al. ..... 439/884

* cited by examiner

*Primary Examiner*—Neil Abrams
(74) *Attorney, Agent, or Firm*—Wei Te Chung

(57) ABSTRACT

A connector (1) for electrically connecting a central processing unit (CPU) with a printed circuit board (PCB) includes an insulative housing (2), passages (20) defined in the housing, and conductive contacts (3) secured in corresponding passages. Each passage includes a fastening recess (202), and the fastening recess includes a flared upper portion (2021). Each contact includes a soldering portion (31) for being soldered to the PCB, a pair of contact portions (33) for engaging with the CPU, and a body portion (32) interconnecting the soldering portion and the contact portions. Two pairs of engaging portions (340) are formed on opposite lateral edges of the body portion respectively. Each engaging portion includes an upper fixing part (3402) and a lower tapered guiding part (3401). When the contact is engaged in the corresponding passage, the tapered guiding parts and the flared upper portion cooperate to facilitate correct insertion of the contact.

2 Claims, 4 Drawing Sheets

ELECTRICAL CONNECTOR WITH ACCURATELY SECURED CONTACTS

BACKGROUND OF THE INVENTION

1. Field of the Invention

The present invention relates to an electrical connector for electrically connecting an electronic package such as a pin grid array (PGA) chip with a circuit substrate such as a printed circuit board (PCB), and more particularly to an electrical connector providing accurate positioning of conductive contacts therein.

2. Description of the Related Art

Conventional central processing unit (CPU) sockets have contacts received in passageways of an insulative housing, for electrically connecting CPUs to PCBs. The contacts have engaging portions extending from one or two side edges thereof. The thickness of one whole engaging portion is approximately equal to the width of a fastening recess of each passageway. Thus the engaging portions are firmly held in the passageway, and the contact is securely fixed in the housing.

The trend toward miniaturization of electrical connectors and the development of surface mount technology (SMT) both require precise positioning of the contacts in the passageways. Coplanarity of soldering portions of all contacts in a CPU socket is very important for achieving precise soldering by way of SMT, especially for a ball grid array (BGA) connector. Conventional contacts are too small to be accurately inserted into the passageways of a housing of a BGA socket. Small gaps remain between interferential engaging portions of each contact and walls of the housing at a fastening recess of each passageway. In addition, the contacts may be inaccurately installed in the corresponding passageways during assembly of the BGA connector. For example, some contacts may be inserted at incorrect angles. This causes soldering portions of the contacts to be tilted relative to a PCB. The above-mentioned small gaps can be eliminated by ensuring that a thickness of the engaging portion of the contact is exactly equal to a width of the fastening recess of the passageway. However, insertion of the contact into the passageway is difficult and problematic. Forced insertion can result in plastic deformation of the housing at the passageway, and damage to the contact itself. Retaining the contacts in correct positions while still ensuring coplanarity of the soldering portions of the contacts has not yet been satisfactorily achieved. There remains unduly high risk of unstable connection between the contacts and the PCB. Contacts such as those disclosed in the U.S. Pat. Nos. 6,319,038, 5,797,774 and 5,299,950 bear out the above-described problems.

An improved CPU socket is desired to overcome the above-described shortcomings of conventional CPU sockets.

SUMMARY OF THE INVENTION

An object of the present invention is to provide an electrical connector having precisely positioned contacts for ensuring reliable electrical connection between soldering portions of the contacts and a printed circuit board (PCB).

To achieve the above object, a connector of the present invention is for electrically connecting pins of a central processing unit (CPU) with a PCB. The connector comprises an insulative housing, a multiplicity of passages defined in the housing, and a multiplicity of conductive contacts secured in corresponding passages. Each passage comprises a receiving portion and a fastening recess. The fastening recess comprises a flared upper portion. Each contact comprises a soldering portion for being soldered to the PCB, a pair of contact portions for engaging with a corresponding output pin of the CPU, and a body portion interconnecting the soldering portion and the contact portions. Two pairs of engaging portions are formed on opposite lateral edges of the body portion respectively. Each engaging portion comprises an upper fixing part and a lower guiding part. Each guiding part is tapered such that a bottom end thereof is narrower and thinner than a top end thereof. When the contact is engaged in the corresponding passage of the housing, the tapered guiding parts and the flared upper portion cooperate to facilitate correct insertion of the contact. That is, even if the contact is initially inserted imprecisely or at an incorrect angle, the guide portions and the flared upper portion can gradually lead the contact to a correct final position and orientation in the passage. Thus the contacts can be precisely fixed in the passages of the housing. This ensures reliable connection between the soldering portions and the PCB, and between the contact portions and the output pins of the CPU.

Other objects, advantages and novel features of the present invention will be drawn from the following detailed description of a preferred embodiment of the present invention with attached drawings, in which:

DESCRIPTION OF PREFERRED EMBODIMENT OF THE INVENTION

Reference will now be made to the drawings to describe the present invention in detail.

Figure 1:
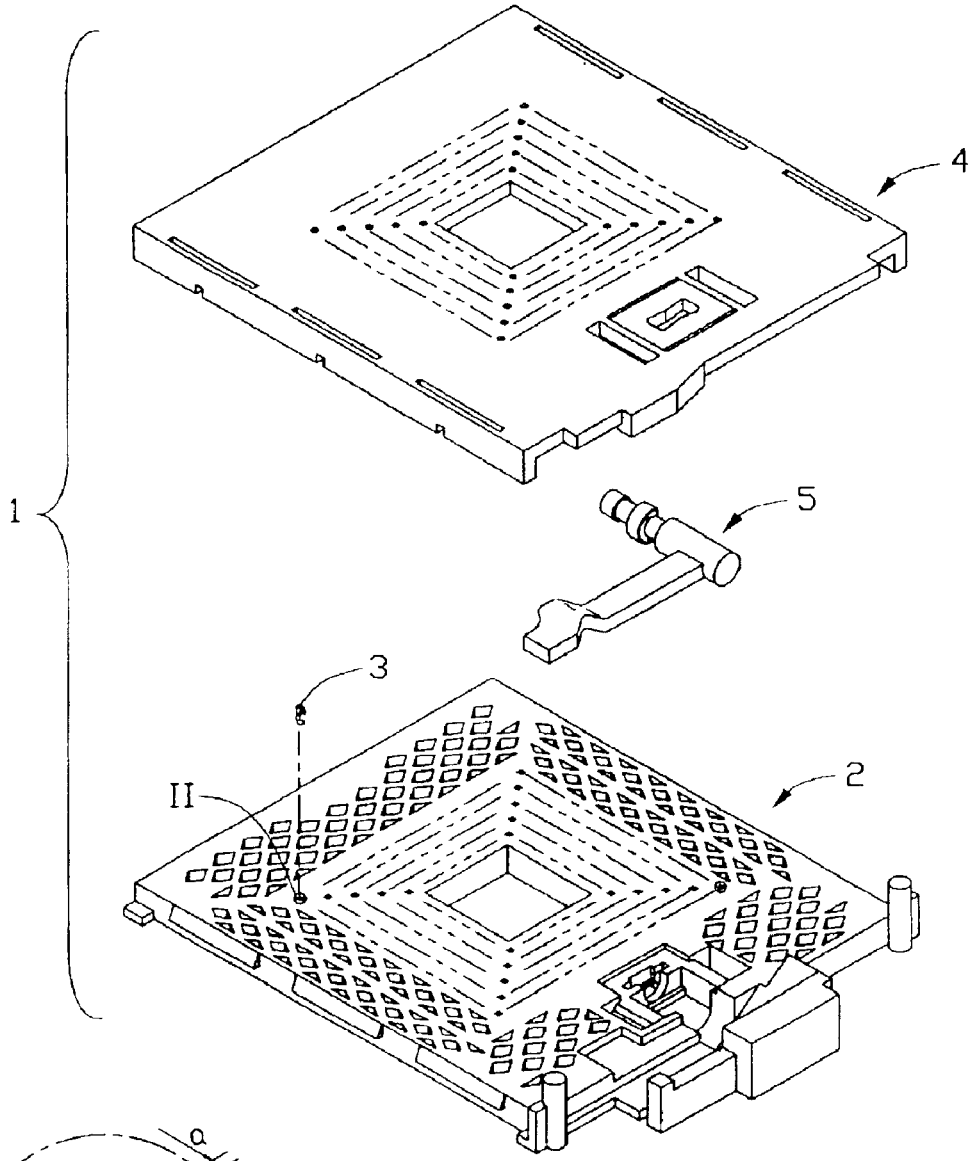
FIG. 1 is an exploded isometric view of the electrical connector in accordance with the preferred embodiment of the present invention, but showing only one contact thereof.
Figure 2:
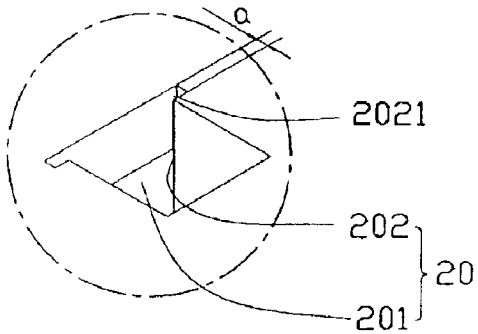
FIG. 2 is an enlarged view of a circled portion II of FIG. 1, showing details of one passage of a housing of the connector.
Figure 3:
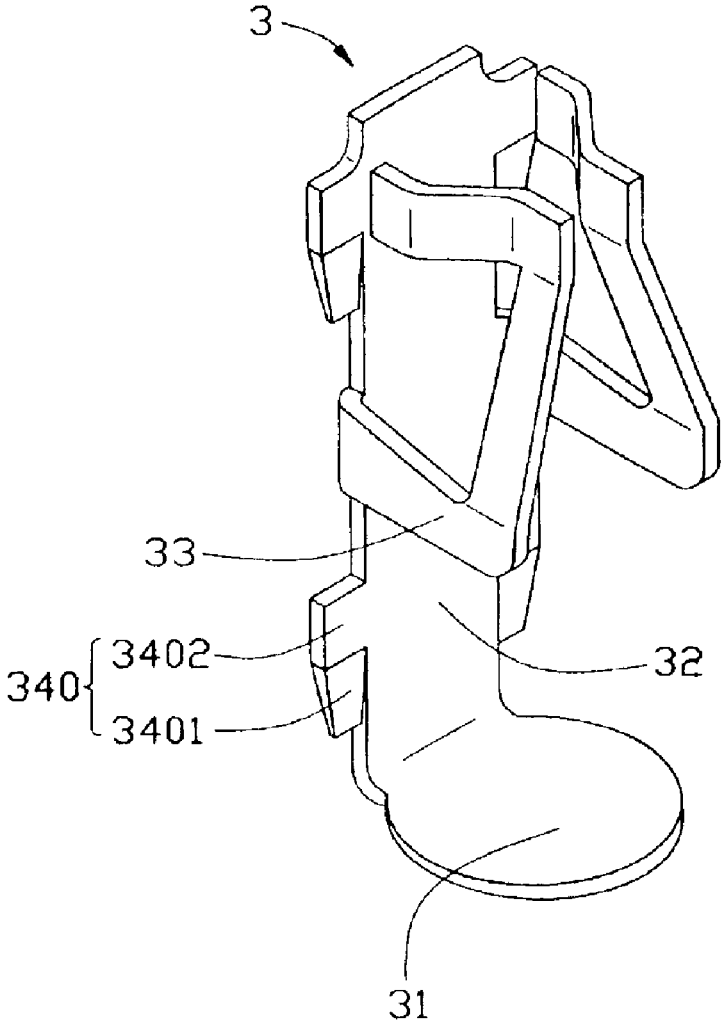
FIG. 3 is an enlarged isometric view of the contact of FIG. 1.
Figures 4A, 4B, 4C:
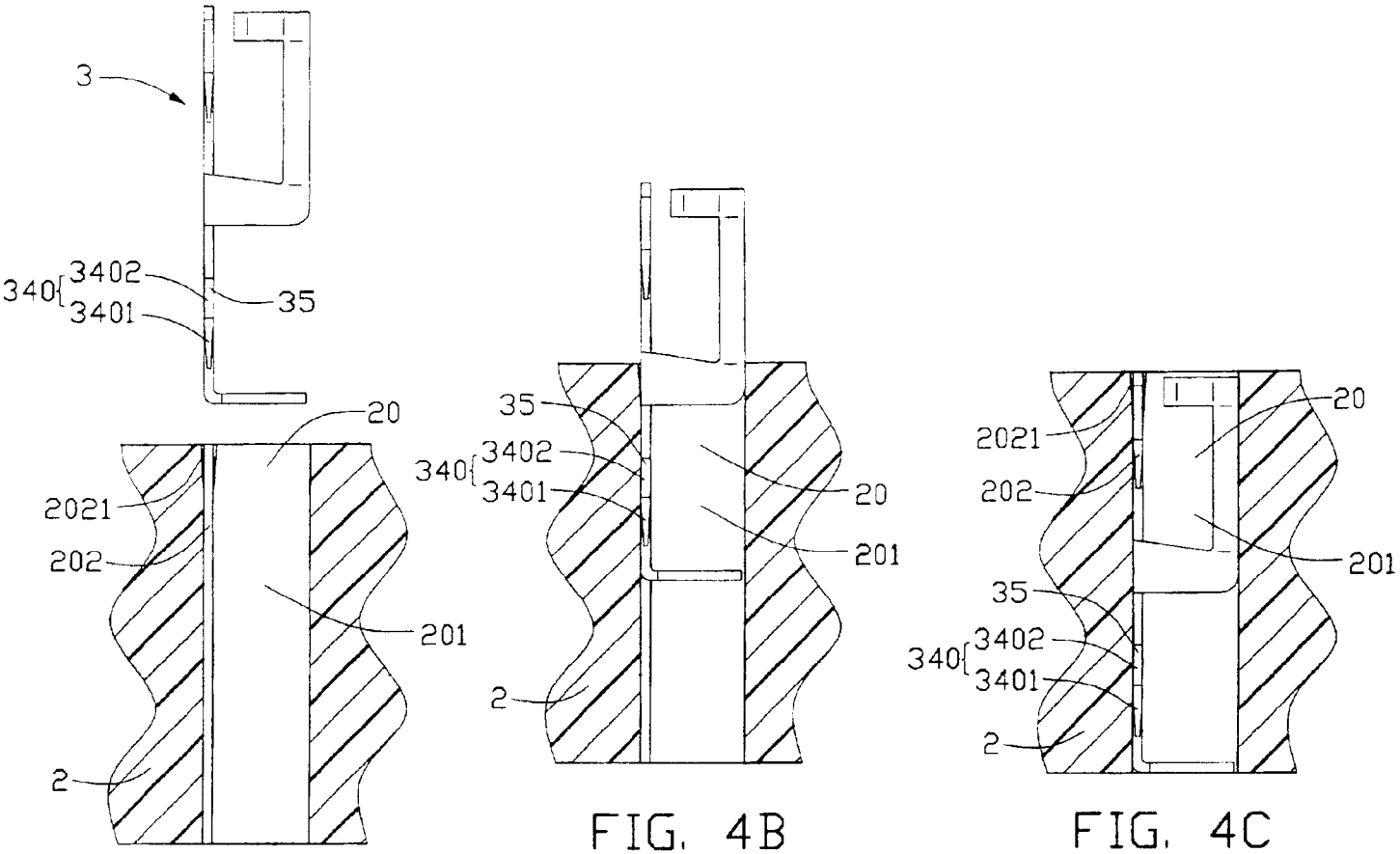
FIG. 4A is an enlarged side plan and partly cross-sectional view of the contact and of the housing at the passage, showing the contact ready to be insert into the passage.
FIG. 4B is similar to FIG. 4A, but showing the contact partly insert into the passage.
FIG. 4C is similar to FIGS. 4A and 4B, but showing the contact fully inserted into the passage.
Figure 5:
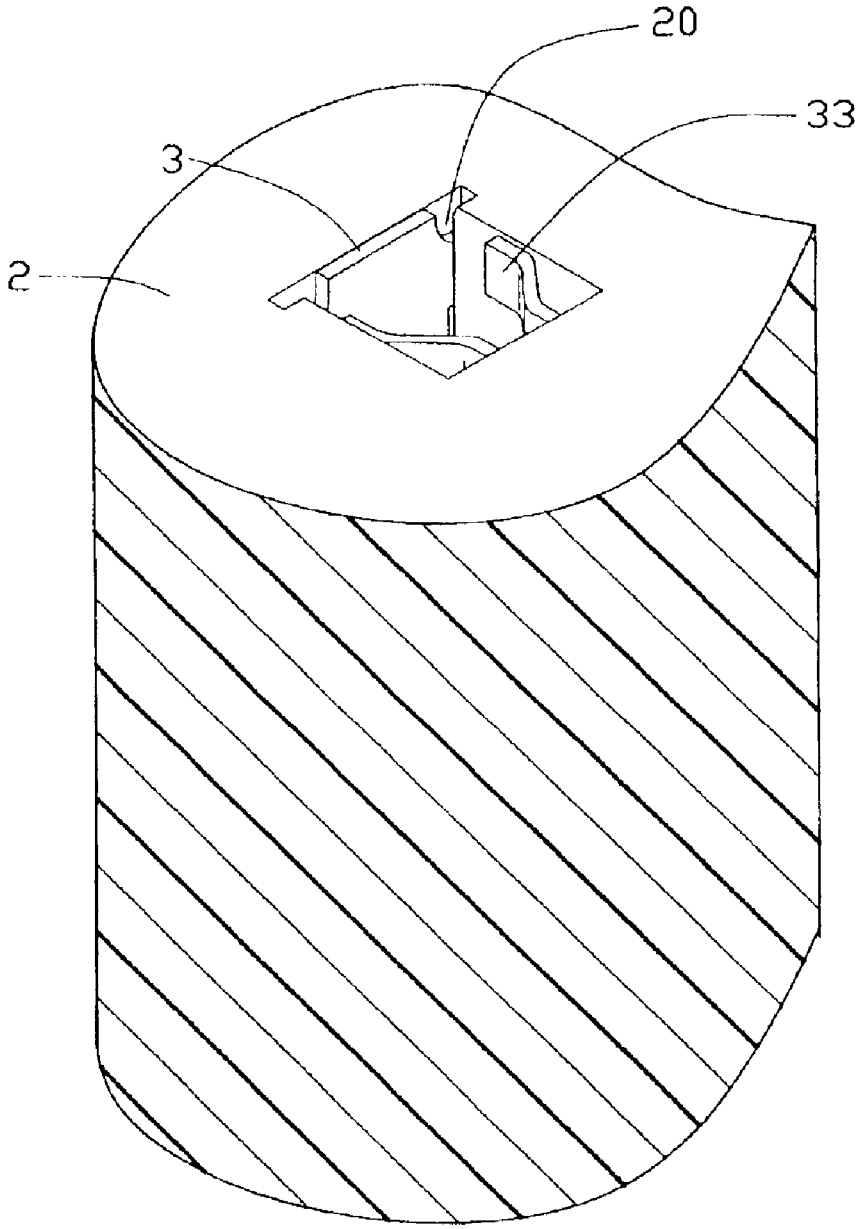
FIG. 5 is an enlarged isometric view of part of the connector of FIG. 1, showing the contact fully inserted into the passage.

Referring to FIGS. 1, 2 and 3, an electrical connector 1 in accordance with a preferred embodiment of the present invention is for electrically connecting a central processing unit (CPU) to a printed circuit board (PCB). The connector 1 comprises an insulative housing 2, a multiplicity of conductive contacts 3 secured in the housing 2, a cover 4 slidably mounted on the housing 2, and an actuation device 5 for actuating the cover 4 to slide along the housing 2. The housing 2 defines a multiplicity of passages 20 respectively receiving the contacts 3. Each passage 20 comprises a receiving portion 201 and a fastening recess 202. Each fastening recess 202 comprises a flared upper portion 2021. That is, the fastening recess 202 is largest at a top surface of the housing 2, for facilitating insertion of a corresponding contact 3 into the passage 20.

Each contact 3 comprises a soldering portion 31 for being soldered to the PCB, a pair of contact portions 33 for engaging with a corresponding output pin (not shown) of the CPU, and a body portion 32 interconnecting the soldering portion 31 and the contact portions 33. The soldering portion 31 is perpendicular to the body portion 32, and parallel to the PCB. Two pairs of engaging portions 340 are formed on opposite lateral edges of the body portion 32 respectively. Each engaging portion 340 comprises a lower guiding part 3401 and an upper fixing part 3402. Each guiding part 3401 is tapered such that a bottom end thereof is narrower and thinner than a top end thereof. A thickness of each fixing part 3402 is slightly greater than a width "a" of the fastening recess 202 of each passage 20, as shown in FIG. 2. Each fixing part 3402 has a distal end 35. The contact portions 33 extend from respective opposite lateral edges of the body portion 32 between corresponding engaging portions 340.

Referring to FIGS. 4*a*, 4*b*, 4*c* and 5, the contacts 3 are engaged in the passages 20 of the housing 2. The body portion 32 of each contact 3 is inserted into the corresponding fastening recess 202, and the soldering and contact portions 31, 33 of the contact 3 are received in the corresponding receiving portion 201. The tapered guiding parts 3401 and the flared upper portion 2021 cooperate to facilitate correct insertion of the contact 3. That is, even if the contact 3 is initially inserted imprecisely or at an incorrect angle, the guide portions 3401 and the flared upper portion 2021 can gradually lead the contact 3 to a correct final position and orientation in the passage 20. Thus the contacts 3 can be precisely fixed in the passages 20 of the housing 2. This ensures reliable connection between the soldering portions 31 and the PCB, and between the contact portions 33 and the output pins of the CPU.

When each contact 3 is finally fixed in its corresponding passage 20, the distal ends 35 of the fixing parts 3402 press corresponding side walls of the housing 2 at the fastening recess 202. In addition, opposite faces of the fixing parts 3402 interferentially engage with corresponding side walls of the housing 2 at the fastening recess 202, because the thickness of each fixing part 3402 is slightly greater than the width of the fastening recess 202. Thus the contact 3 is firmly and reliably secured in the passage 20.

Although the present invention has been described with reference to a particular embodiment, it is not to be construed as being limited thereto. Various alterations and modifications can be made to the embodiment without in any way departing from the scope or spirit of the present invention as defined in the appended claims.

What is claimed is:

1. A connector for electrically connecting an electronic package with a circuit substrate, the connector comprising:

an insulative housing defining a plurality of passages therein; and a plurality of contacts secured in corresponding passages;

wherein each of the contacts comprises a soldering portion for being soldered to the circuit substrate, at least one contact portion for engaging with the electronic package, and a body portion interconnecting the soldering portion with the at least one contact portion, and the body portion comprises at least one tapered guiding part for facilitating insertion of the contact into a corresponding passage, the guiding part comprising two opposite slant side surfaces;

wherein each of the passages comprises a receiving portion for receiving the at least one contact portion of a corresponding contact, and a fastening recess for receiving the body portion of the corresponding contact;

wherein the fastening recess comprises a flared upper portion for facilitating insertion of the contact into the passage;

wherein the body portion of the contact comprises a plurality of engaging portions at opposite lateral edges thereof, and each of the engaging portions comprises one said guiding part and a fixing part;

wherein the contact comprises two said contact portions, the body portion of the contact comprises two pairs of said engaging portions at the opposite lateral edges thereof, and the contact portions extend from the opposite lateral edges of the body portion between corresponding engaging portions.

2. A connector for electrically connecting an electronic package with a circuit substrate, the connector comprising:

an insulative housing defining a plurality of passages therein; and a plurality of contacts secured in corresponding passages;

wherein each of the contacts comprises a body portion, and the body portion comprises a first part adapted to be snugly received in a corresponding passage, and a tapered second part having two opposite slant side surfaces for guiding the first part into the corresponding passage;

wherein each of the contacts further comprises a soldering portion for being fixed to the circuit substrate, and at least one contact portion for engaging with the electronic package;

wherein each of the passages comprises a receiving portion for receiving the at least one contact portion of a corresponding contact, and a fastening recess for receiving the body portion of the corresponding contact;

wherein the fastening recess comprises a flared upper portion for facilitating insertion of the contact into the passage;

wherein the body portion of the contact comprises a plurality of engaging portions at opposite lateral edges thereof, and each of the engaging portions comprises one said first part for interferential engagement in the fastening recess and one said second part for guiding the first part into the fastening recess;

wherein the contact comprises two said contact portions, the body portion of the contact comprises two pairs of said engaging portions at the opposite lateral edges thereof, and the contact portions extend from the opposite lateral edges of the body portion between corresponding engaging portions.

* * * * *